US008757990B2

(12) United States Patent
Liu et al.

(10) Patent No.: US 8,757,990 B2
(45) Date of Patent: Jun. 24, 2014

(54) BLOWER FAN

(75) Inventors: Xiang Liu, Zhongshan (CN); Ping Lu, Zhongshan (CN); Miao Zhang, Zhongshan (CN)

(73) Assignee: Zhongshan Broad-Ocean Motor Manufacturing Co., Ltd., Zhongshan (CN)

( * ) Notice: Subject to any disclaimer, the term of this patent is extended or adjusted under 35 U.S.C. 154(b) by 116 days.

(21) Appl. No.: 13/405,347

(22) Filed: Feb. 26, 2012

(65) Prior Publication Data

US 2012/0164003 A1 Jun. 28, 2012

Related U.S. Application Data

(63) Continuation of application No. PCT/CN2010/077665, filed on Oct. 12, 2010.

(30) Foreign Application Priority Data

Dec. 25, 2009 (CN) ..... 200920295851
Dec. 25, 2009 (CN) ..... 200920295875

(51) Int. Cl.

| | |
|---|---|
| ***F04D 13/06*** | (2006.01) |
| ***F04D 29/62*** | (2006.01) |
| ***F04D 29/66*** | (2006.01) |
| ***F04D 29/60*** | (2006.01) |

(52) U.S. Cl.

CPC ..... *F04D 13/06* (2013.01); *F04D 29/603* (2013.01); *F04D 29/668* (2013.01)
USPC ..... 417/423.8; 417/423.15; 417/360

(58) Field of Classification Search

CPC ..... F04D 13/06; F04D 29/603; F04D 29/624; F04D 29/668
USPC ..... 417/423.8, 423.14, 423.15, 360
See application file for complete search history.

(56) References Cited

U.S. PATENT DOCUMENTS 2,927,228 A * 3/1960 Rockafield ..... 310/91
5,040,943 A * 8/1991 Dwyer et al. ..... 415/26
5,375,651 A * 12/1994 Colwell ..... 165/47

* cited by examiner

*Primary Examiner* — Bryan Lettman
(74) *Attorney, Agent, or Firm* — Matthias Scholl P.C.; Matthias Scholl

(57) ABSTRACT

A blower fan including a motor having a rotating shaft, a bracket, a fan housing having a cavity, a fan wheel, and fan blades. The motor is disposed on the fan housing via the bracket. An extended portion of the rotating shaft extends into the cavity of the fan housing and connects with the fan wheel. The fan blades are disposed on the rotating shaft and between the motor and the fan housing. On the casing of the motor is disposed with air vents. The bracket forms an annular side wall. A cavity is formed inside the annular side wall. The annular side wall is outfitted with air outlets which are connected with the cavity of the annular side wall and the fan blades are disposed in the cavity.

5 Claims, 6 Drawing Sheets

BLOWER FAN

CROSS-REFERENCE TO RELATED APPLICATIONS

This application is a continuation of International Patent Application No. PCT/CN2010/077665 with an international filing date of Oct. 12, 2010, designating the United States, now pending, and further claims priority benefits to Chinese Patent Application No. 200920295875.3 filed Dec. 25, 2009, and to Chinese Patent Application No. 200920295851.8 filed Dec. 25, 2009. The contents of all of the aforementioned applications, including any intervening amendments thereto, are incorporated herein by reference.

BACKGROUND OF THE INVENTION

1. Field of the Invention

The invention relates to a blower fan.

2. Description of the Related Art

A conventional blower fan includes a motor, a bracket, fan blades, a fan housing, and a fan wheel, in which the motor is disposed on the fan housing by means of the bracket, an extended portion of a motor rotating shaft extends into a cavity of the fan housing and connects with the fan wheel, and the fan blades are disposed on the motor rotating shaft and between the motor and the fan housing. Conventionally, there are two types of connection structures between the motor and the bracket, one is that the spiral case is attached to the motor via a cast aluminium tripod and the other one is that the spiral case is attached to the motor via a punched U-shape bracket. However, the foregoing structures have the following disadvantages:

1) because the motor has a certain weight, such two structures cannot satisfactorily transfer the weight to the fan housing; therefore, the stress is relatively centralized. When the motor works, it would produce large vibration and noises, and in the worst scenario, the bracket and the fan housing could be deformed; and
2) heat dissipation effect is not good enough as the heat cannot be fully dispersed from the motor because of the mere application of the fan blades.

SUMMARY OF THE INVENTION

In view of the above-described problems, it is one objective of the invention to provide a blower fan that can evenly distribute the motor weight throughout the fan housing and is reliable, unlikely to be deformed and produces fewer noises.

To achieve the above objective, in accordance with one embodiment of the invention, there provided is a blower fan, comprising a motor comprising a rotating shaft, a bracket, a fan housing comprising a cavity, a fan wheel, and fan blades, wherein the motor is disposed on the fan housing by means of the bracket, an extended portion of the rotating shaft extends into the cavity of the fan housing and connects with the fan wheel, the fan blades are disposed on the rotating shaft and between the motor and the fan housing, and on the casing of the motor is disposed with air vents, the bracket forms an annular side wall, a cavity is formed inside the annular side wall, the annular side wall is disposed with air outlets, the air outlets are connected with the cavity of the annular side wall, and the fan blades are disposed in the cavity of the annular side wall.

In a class of this embodiment, a top end of the annular side wall extends inward to form a bottom surface, the bracket is connected with the end surface of the motor casing via the bottom surface, a bottom end of the annular side wall extends outward to form a raised edge, and the bracket is connected with the fan housing via the raised edge.

In a class of this embodiment, the raised edge is a plane plate and the bracket is in the shape of a bowl.

In a class of this embodiment, an anti-vibration and heat insulation pad is disposed between the raised edge and the fan housing.

In a class of this embodiment, an end portion of the rotating shaft extends out of the motor casing and is disposed with a top blade.

In a class of this embodiment, the motor is mounted on the bracket by rivets and the bracket is mounted on the fan housing by rivets.

Advantages of the invention are summarized below:

1) The bracket forms an annular side wall, the top end of the annular side wall extends inward to form the bottom surface and the bracket is connected with the end surface of the motor casing through the bottom surface, the bottom end of the annular side wall extends outward to form a raised edge, and the bracket is attached to the fan housing via the raised edge. Such a structure allows the bracket to have a large joint surface, even stress, secure connection, therefore low vibration and noises are achieved and the bracket is unlikely to be deformed;
2) On the top of the motor casing is disposed with a top blade, the annular side wall forms a cavity inside to accommodate fan blades and is disposed with air outlets to form a stable air channel. When cold air enters through the air vents on the top of the motor casing, parts of the air will be discharged from the air outlets on the side wall of the motor casing after heat exchange and the rest of the air will be sucked into the cavity of the annular side wall by the fan blades, so that the cold air can fully contact with the motor's rotor and stator to absorb heat, which is to be discharged from the air outlets on the annular side wall. In this way, rapid heat dissipation speed and excellent heat dissipation effects are achieved; and
3) An anti-vibration and heat insulation pad is disposed between the raised edge and the fan housing, it can reduce vibration and the heat produced by the fan is unlikely to be transferred to the bracket and the motor, so that the motor can carry out normal operation under certain temperatures.

DETAILED DESCRIPTION OF THE EMBODIMENTS

Figure 1:
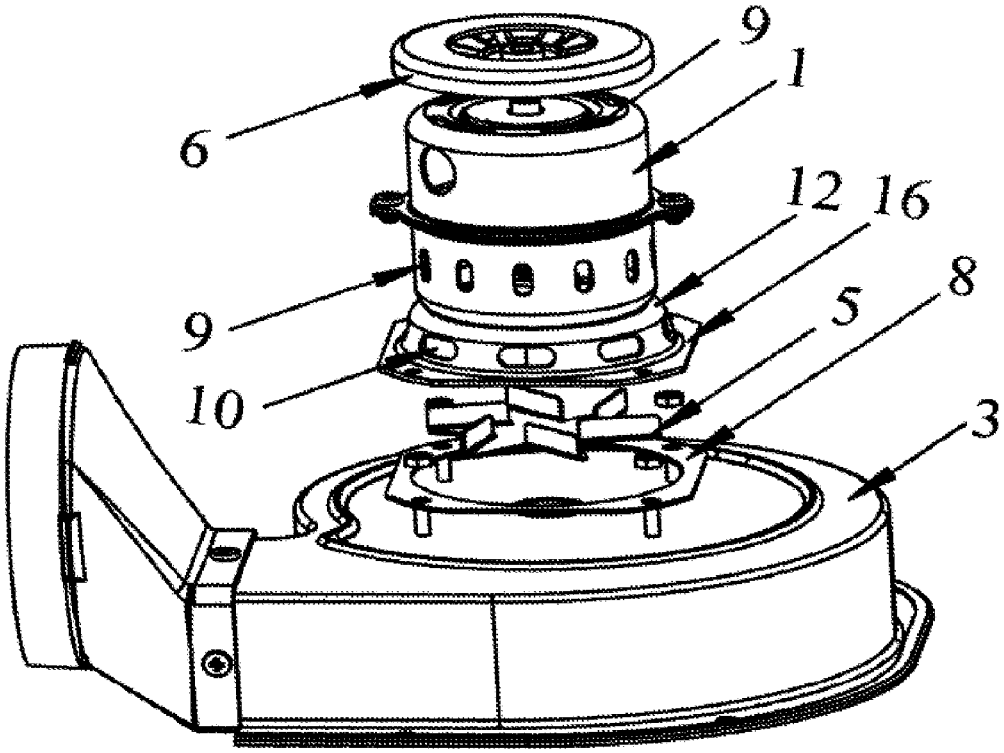
FIG. 1 is an exploded view of a blower fan in accordance with one embodiment of the invention.
Figure 2:
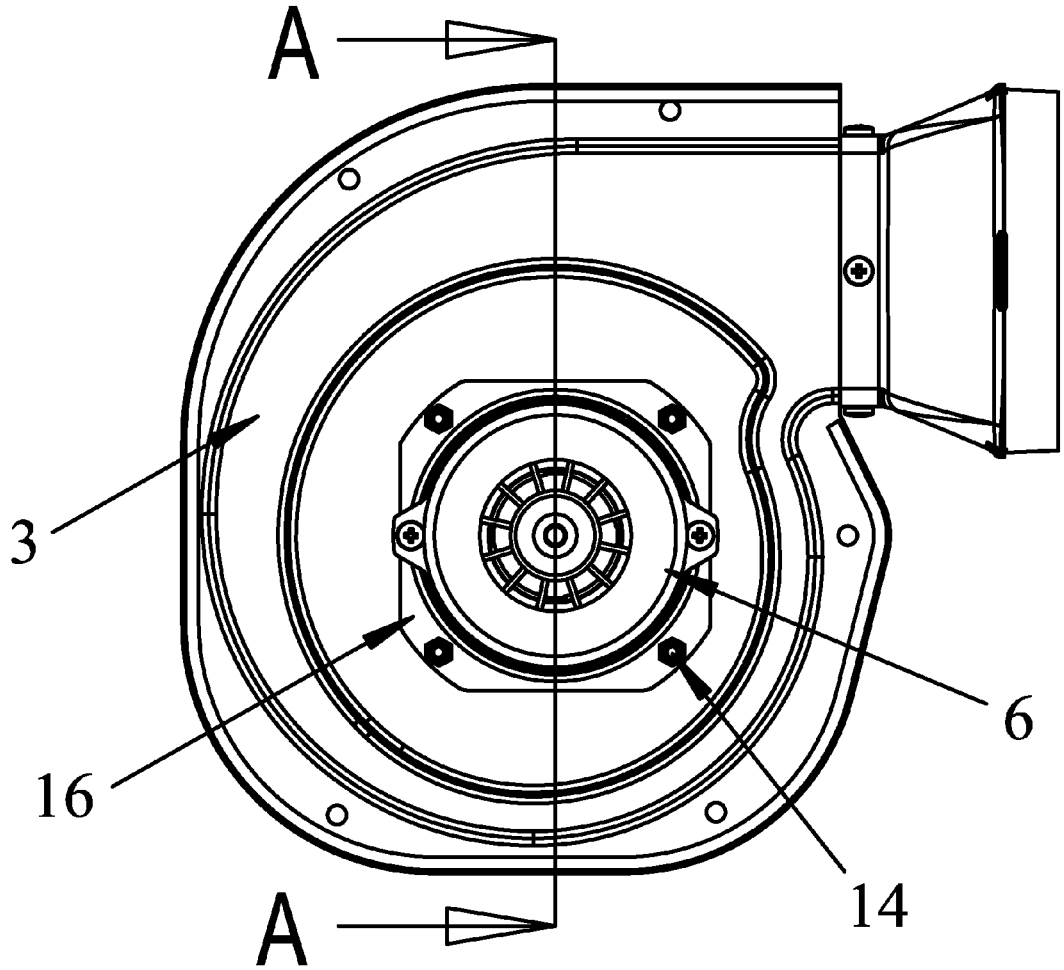
FIG. 2 is a schematic diagram of a blower fan in accordance with one embodiment of the invention.
Figure 3:
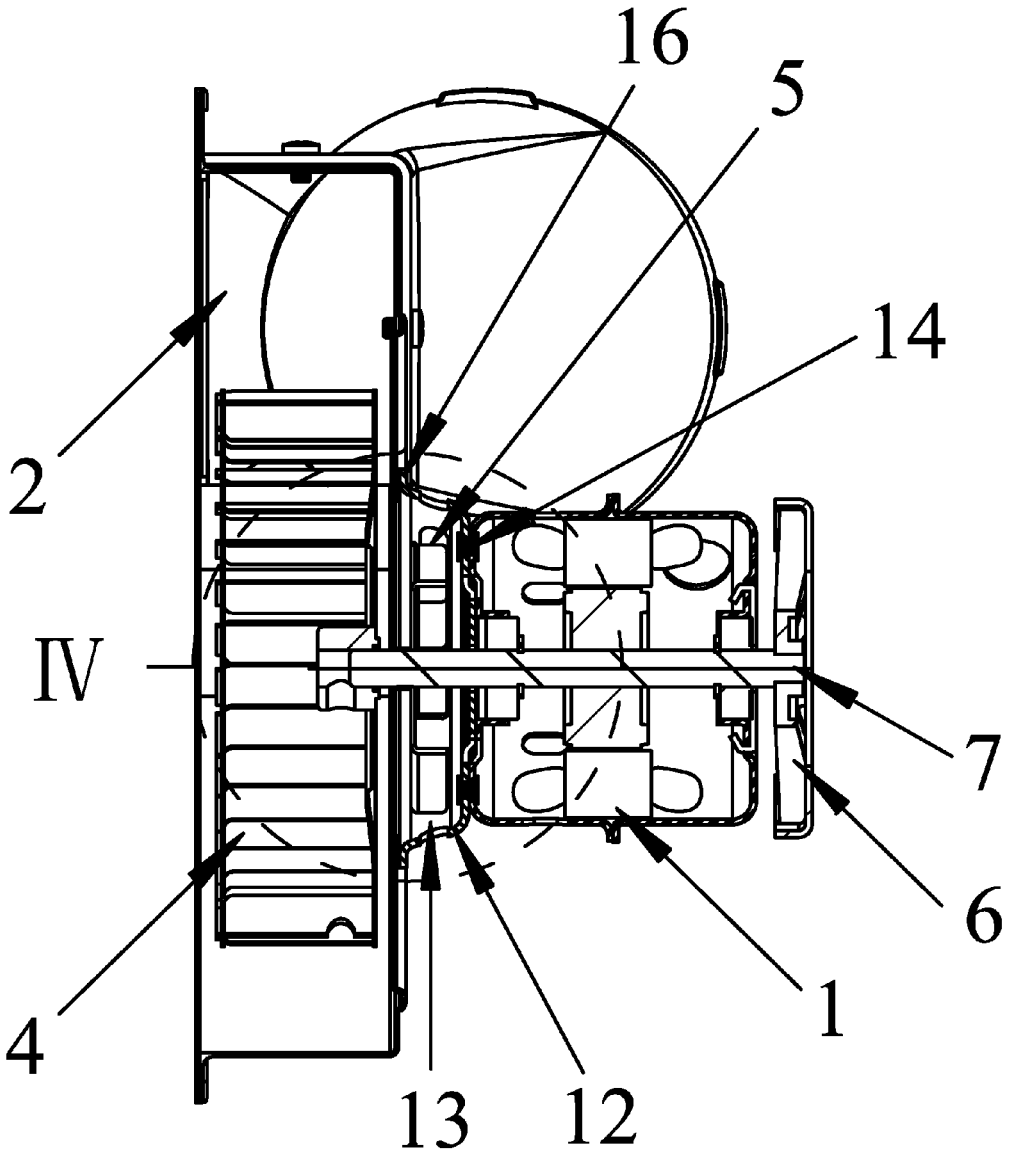
FIG. 3 is a sectional view of FIG. 2 taken from the line A-A.
Figure 4:
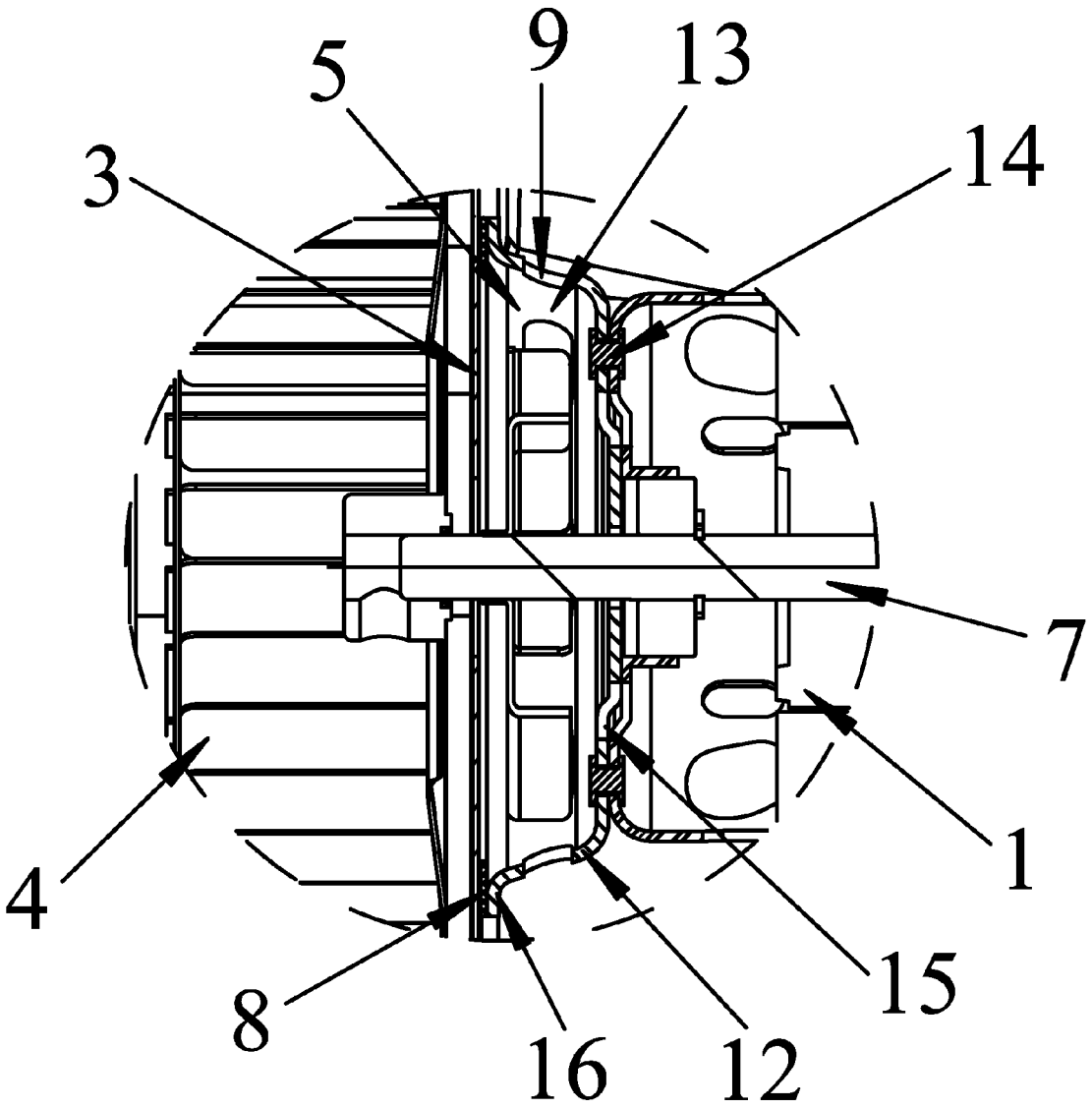
FIG. 4 is an enlarged view of part IV of FIG. 3.

For further illustrating the invention, experiments detailing a blower fan are described below. It should be noted that the following examples are intended to describe and not to limit the invention.

As shown in FIGS. 1-4, a blower fan comprises a motor 1 comprising a rotating shaft 7, a bracket, a fan housing 3 comprising a cavity 2, a fan wheel 4, and fan blades 5. The motor 1 is disposed on the fan housing 3 by means of the bracket. The extended portion of the rotating shaft 7 extends into the cavity 2 of the fan housing 3 and connects with the fan wheel 4. The fan blades 5 are disposed on the rotating shaft 7 and between the motor 1 and the fan housing 3. On the casing of the motor 1 is disposed with air vents 9. The bracket forms an annular side wall 12, and a cavity 13 is formed inside the annular side wall 12. The annular side wall 12 is disposed with air outlets 10, the air outlets 10 are connected with the cavity 13 of the annular side wall 12 and the fan blades 5 are disposed in the cavity 13 of the annular side wall 12.

The top end of the annular side wall 12 extends inward to form a bottom surface 15, the bracket is connected with the end surface of the motor 1 casing via the bottom surface 15, the bottom end of the annular side wall 12 extends outward to form a raised edge 16, and the bracket is connected with the fan housing 3 via the raised edge 16.

The raised edge 16 is a plane plate and the bracket is in the shape of a bowl.

An anti-vibration and heat insulation pad 8 is disposed between the raised edge 16 and the fan housing 3, and the end portion of the rotating shaft 7 extends out of the motor 1 casing and is disposed with a top blade 6.

The motor 1 is mounted on the bracket by rivets and the bracket is mounted on the fan housing 3 by rivets 14.

The blower fan of the invention is simple, reliable, and meanwhile it produces low vibration and noises as well as has a rapid heat dissipation speed.

Figure 5:
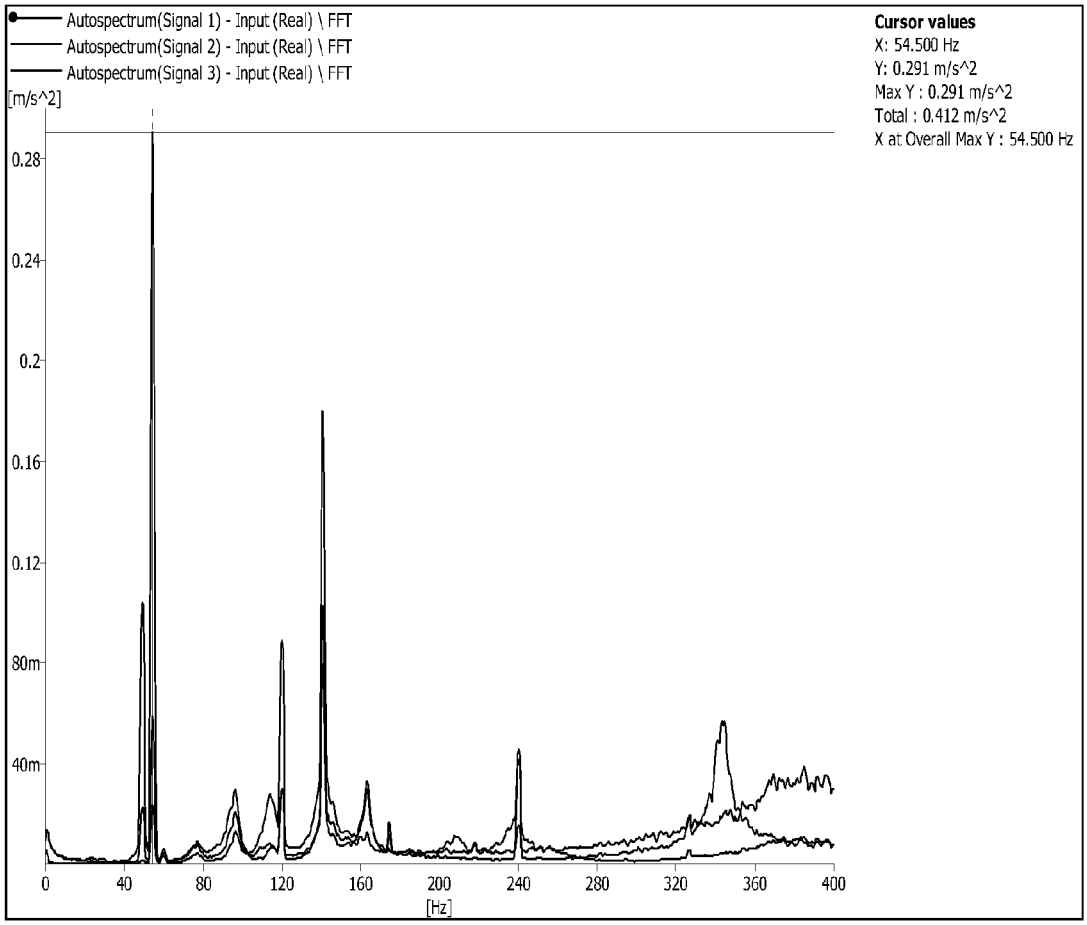
FIG. 5 is an experimental data chart for vibration detection of a blower fan in accordance with one embodiment of the invention.
Figure 6:
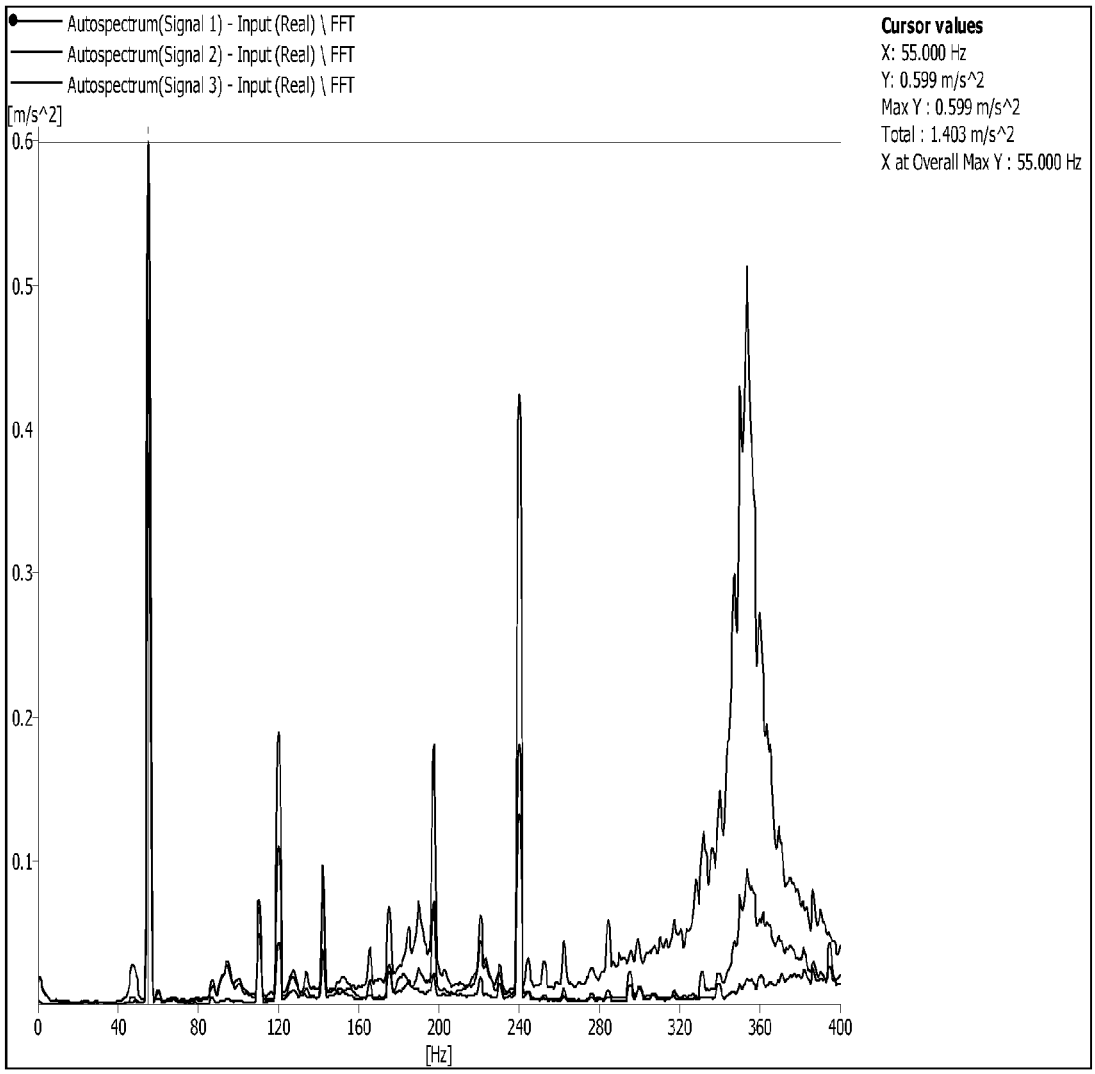
FIG. 6 (Prior art)
FIG. 6 is an experimental data chart for vibration detection of a blower fan in the art.

As shown in FIG. 5, the experimental data shows that the maximum vibration value in a certain direction is 0.412 $m/s^2$ when the blower fan provided by the invention is under the vibration frequency of 54.5 Hz and the maximum vibration value in a certain direction is 1.403 $m/s^2$ when a conventional fan is under the vibration frequency of 55 Hz as shown in FIG. 6. The blower fan provided by the invention, by contrast, has a significant advantage that the vibration is largely reduced, so do the noises.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A blower fan, comprising:

a) a motor comprising a rotating shaft and a casing;

b) a bracket;

c) a fan housing comprising a cavity;

d) a fan wheel; and e) fan blades;

wherein:

the motor is disposed on the fan housing by means of the bracket;

an extended portion of the rotating shaft extends into the cavity of the fan housing and connects with the fan wheel;

the fan blades are disposed on the rotating shaft and between the motor and the fan housing;

the casing of the motor is disposed with air vents;

the bracket forms an annular side wall, and a cavity is formed inside the annular side wall;

the annular side wall comprises air outlets;

the air outlets are connected with the cavity of the annular side wall;

the fan blades are disposed in the cavity of the annular side wall;

a top end of the annular side wall extends inward to form a motor-support plate;

the bracket is connected with an end surface of the motor casing via the motor-support plate;

a bottom end of the annular side wall extends outward to form a housing-contact plate;

the bracket is connected to the fan housing via the housing-contact plate;

a pad is disposed between the housing-contact plate and the fan housing for resisting vibration and insulating heat;

the housing-contact plate is centrosymmetric; and the pad is a centrosymmetric plate.

2. The blower fan of claim 1, wherein the bracket is in the shape of a bowl.

3. The blower fan of claim 1, wherein an end portion of the rotating shaft extends out of the motor casing and is disposed with a top blade.

4. The blower fan of claim 3, wherein the motor is mounted on the bracket by rivets and the bracket is mounted on the fan housing by rivets.

5. The blower fan of claim 1, wherein the housing-contact plate is disposed within an area of the pad.

* * * * *